United States Patent [19]

Gordon et al.

[11] 4,433,808

[45] Feb. 28, 1984

[54] POURABLE, RECLOSEABLE LID

[75] Inventors: Robert L. Gordon, Monroe; John G. Smith, Warwick, both of N.Y.

[73] Assignee: International Paper Company, New York, N.Y.

[21] Appl. No.: 374,128

[22] Filed: May 3, 1982

[51] Int. Cl.[3] ..... B65D 5/64; B65D 5/54; B65D 5/70

[52] U.S. Cl. ..... 229/43; 206/622

[58] Field of Search ..... 229/43, 7 R, 17 R, 44 R; 206/622

[56] References Cited

U.S. PATENT DOCUMENTS

| | | | |
|---|---|---|---|
| 105,157 | 7/1870 | Alexander . | |
| 1,260,299 | 3/1918 | Banes . | |
| 1,837,652 | 12/1931 | Choate . | |
| 2,146,226 | 2/1939 | Punte | 220/67 |
| 2,615,610 | 10/1952 | White | 229/17 R |
| 2,719,663 | 10/1955 | Jagenberg | 229/17 R |
| 2,847,151 | 8/1958 | Jagenberg | 229/43 |
| 2,946,496 | 7/1960 | Stagmeier | 229/17 |
| 3,187,977 | 6/1965 | Graybill | 229/17 |
| 3,235,164 | 2/1966 | Anderson | 229/43 |
| 3,274,964 | 9/1966 | Griese | 229/43 |
| 3,298,505 | 1/1967 | Stephenson | 229/43 |
| 3,640,446 | 2/1972 | Grieve | 229/17 R |
| 3,768,719 | 10/1973 | Johnson | 229/14 B |
| 3,951,331 | 4/1976 | Smith | 229/43 |

*Primary Examiner*—Herbert F. Ross
*Attorney, Agent, or Firm*—Richard J. Ancel

[57] ABSTRACT

The present invention is directed to a top closure lid construction for a container. The lid is integrally formed from a plastic cover member, the member carrying a main paperboard insert on its upper surface, the member and insert being secured together. The plastic cover member has an integral tongue to define, upon tongue pivoting, an opening in the member. The main paperboard insert is hinged about a contiguous pivot axis, and carries a pull tab. Spaced lugs or detents are provided to facilitate reclosing of the closure. If formed from a brittle plastics material, pulling the pull tab breaks the plastics member at its tongue hinge. The closure lid further includes an upstanding wall which enables stacking.

11 Claims, 3 Drawing Figures

POURABLE, RECLOSEABLE LID

BACKGROUND OF THE INVENTION

This invention relates to the art of containers, particularly to containers formed of paperboard or the like. The invention exhibits particular utility as a top lid closure construction for a container.

With the increasing costs of metal for lidding containers, manufacturers seek less expensive materials such as paperboard. Apart from their obvious appeal on grounds of costs and graphics, there is a need in the container art for container top closures which exhibit the property of easy opening and reclosure. The use of plastics materials in combination with paperboard containers has long been recognized in the container art, as, for example, plastic snap lids for paperboard containers. Heretofore, however, the use of all plastic materials as the top closure of a container has not been entirely saitsfactory in those instances wherein a reclosable opening in the container top is desired. This is because of the inherent resiliency of the all plastic lid, i.e., its tendency to regain its original, closed configuration, additional cost and lack of printability.

SUMMARY OF THE INVENTION

By the practice of this invention, a top lid container construction is formed which employs both plastics materials and paperboard, using the best properties of each, to thereby admit of the formation of a novel hinge construction, particularly in the case wherein a relatively brittle plastic such as styrene is employed.

The full nature of the invention will be understood from the accompanying drawings and the following description and claims.

DETAILED DESCRIPTION OF THE INVENTION

Figure 1:
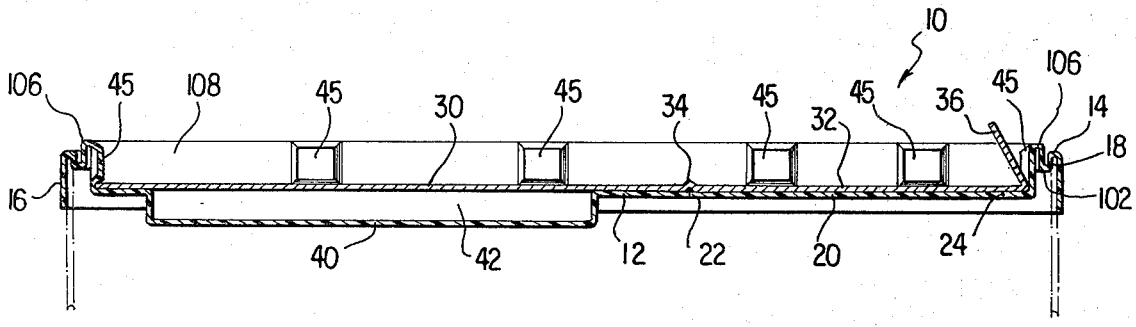
FIG. 1 is a longitudinal cross-sectional view of a top cover closure construction according to this invention.

Referring now to the drawings, the numeral 10 denotes a top closure construction according to this invention. The numeral 12 denotes an integral cover or closure member formed of a relatively brittle plastics material, such as styrene. The member 12 is provided along its outer periphery with an upstanding ridge or bight portion 14, this portion integrally joining vertically disposed wall or skirt portions 16 and 18. Dashed lines at FIG. 1 indicate the top open rim of a paperboard or other container, the rim being sealingly sandwiched between walls 16 and 18. As shown most clearly at FIGS. 2 and 3, the numeral 20 denotes a tongue integral with cover member 12, the tongue being defined by a cut 24 extending through at least the major portion of the thickness of member 12, and by perforated line 22. Line 22 defines a pivot or hinge for tongue 20 as will be presently described.

A main paperboard insert denoted by the numeral 30 extends across and is bonded to at least the major portion of the top flat surface of cover member 12. The numeral 32 denotes an end area or region of main paperboard insert 30, this end area being superposed over tongue 20 and the right hand (as viewed at FIGS. 1 and 2) portion of member 12. A hinge line 34, formed as by deformation or any method, extends across the width of paperboard insert 30. Hinge line 34 is preferably superposed immediately above perforated line 22 in member 12. The right hand edge of end area portion 32 is provided with an integral pull tab 36.

A second pair of upstanding walls 104 and 108, also integral with cover member 12, are integrally joined at each of the wall upper peripheries by bight section or U-channel 106. This wall arrangement provides a stacking capability to the container top closure, the U-channel 106 fitting into a complementary recess or complementary outline in the bottom of a container stacked thereon. The innermost vertically extending wall 108 is provided at its radially innermost surface with a plurality of spaced, integral detents or snapping lugs 45. For aesthetic or other purposes, the entire innermost surface may be provided with such spaced lugs. Those to the right of the hinge line 34, however, perform the function of holding the end portion 32 closed, after initial opening (presently to be described), the width of end portion 32 being slightly greater than the distance between opposing, corresponding pairs of those lugs on the long sides of walls 108. One lug pair is located just to the right (as viewed in FIG. 3) of hinge line 34 to maintain the end portion 32 in the open position. After dispensing, the portion 32 must be forceably pushed past this pair of lugs and the others on the right, to effect reclosure. The detents 45 are inwardly tapered, i.e., they are thinner immediately adjacent the paperboard insert 30 than at their higher portions, as measured from the top surface of insert 30. The detents or lugs 45 also hold the main paperboard insert 30 down on cover member 12.

Figure 3:
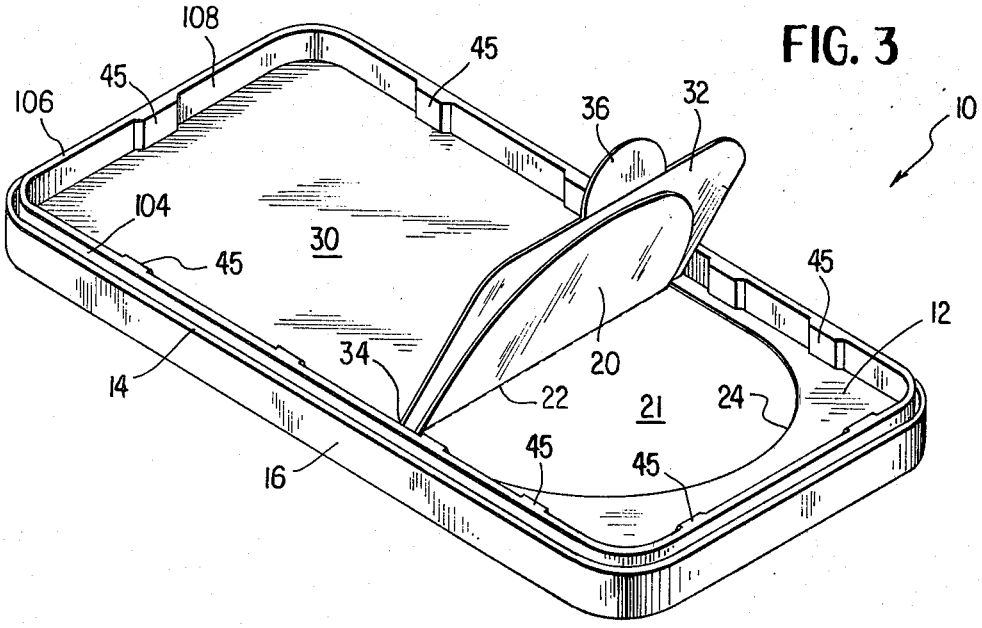
FIG. 3 is a perspective view of the construction shown at FIG. 1 in the open condition.

The mode of operation of the construction is as follows. The top closure lid 10 is placed over the open end of a container, the end rim being sandwiched by walls 16 and 18, the container being indicated in dashed lines at FIG. 1. Then, the top closure lid is sealed or affixed to the open end of the container after the filling of the product, by any convenient method, such as by bonding. When the consumer of the product in the package wishes to obtain access to the contents, the pull tab 36 is pulled upwardly. As may be best visualized by reference to FIG. 3, upward pulling on tab 36 causes end portion 32 to pivot about hinge line 34 of main paperboard insert 30. Conveniently, the main paperboard insert 30 is provided on both sides with a thermoplastic coating which, under conditions of heat and pressure (applied by techniques well known in the art) functions as a bonding agent. By such treatment, the upper surface of tongue 20 is adhered to the lower surface of end portion 32. With continued upward pulling of tab 36, the bond around the periphery of tongue 20, on the top of cover member 12, becomes peeled or separated from the overlying portion of end portion 32. The tongue 20 then pivots upwardly around its hinge or pivot 22, finally arriving at the configuration shown at FIG. 3. If the cover member 12 is formed of a relatively brittle plastics material, such as styrene, the movement of tongue 20 will result in a breaking or snapping of the plastic along perforated line 22, with the result that after the initial opening, as shown at FIG. 3, the tongue is essentially carried entirely by end portion 32, having been broken off from the remainder of cover member 12 along the hinge line 22. By this construction, the advantage of a rigid plastics member as a seal is attained, without the disadvantage of the dispensing mouth cover (tongue 20) tending to resiliently bend back to block or obstruct mouth 21 when the container contents are being dispensed.

In its upward pivoting or swinging motion about its hinge line 34, end portion 32 moves by and contacts pairs of inwardly directed detents 45 located just to the right, as viewed at FIG. 1, of hinge line 34, on the inner peripheral portion of upstanding wall 18. The paperboard insert portion 32 is slightly squeezed at its edges in passing between these detents. By virtue of this action, when the end portion 32 reaches the position shown at FIG. 3, it is inhibited from falling, as by the action of gravity, back to its closed position by virtue of opposed detents 45.

The user may now dispense the contents of the container as the contents pour through tongue opening 21 in cover member 12. After the dispensing operation, the lid portion 32 is pushed downwardly, against the action of detents 45, so as to assume a closed position. These detents assist in maintaining the main paperboard insert 30 in place after it has been opened up to obtain access to well 42.

Figure 2:
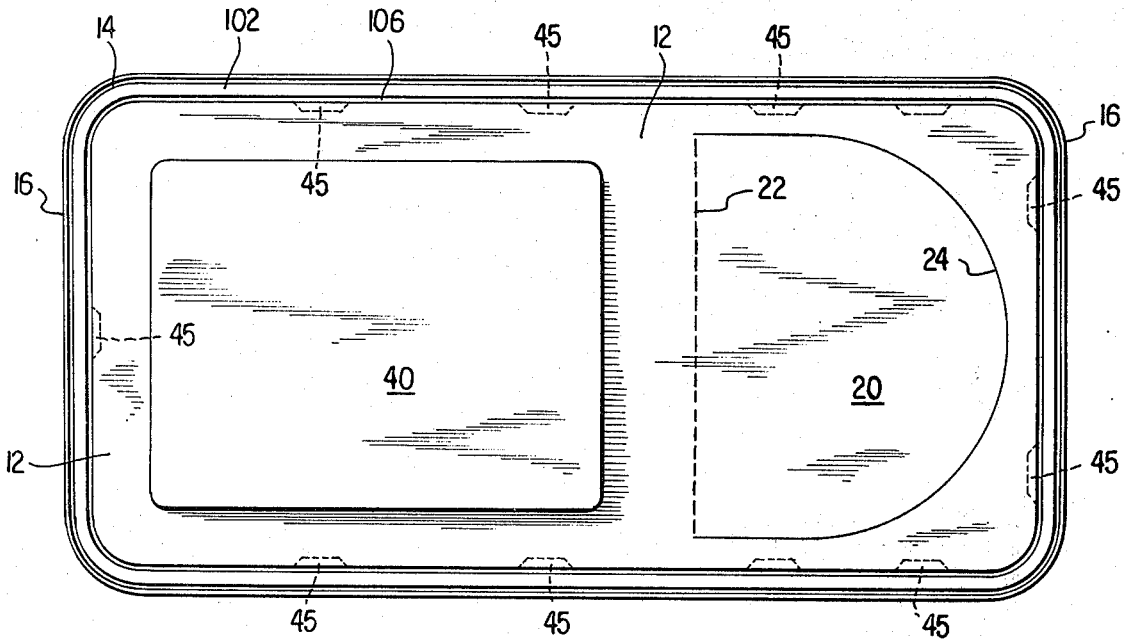
FIG. 2 is a bottom plan view of the construction of FIG. 1.

The cover member 12 may provide a well for coupons or other promotional material. A depressed portion 40 in cover member 12, as shown at FIGS. 1 and 2, provides a well or storage zone 42 for coupons or other promotional material. Access to the well is effected by tearing off the insert 30 after the container is emptied.

The container that is used in connection with the top closure lid construction 10 described herein generally comprises a body portion made from a five-layer construction consisting of (from the outside in): polyethylene (P.E.)/paperboard (solid bleached sulfate)/P.E./-foil/P.E. Other laminate constructions can be utilized if necessary. For example, another such construction consists of P.E./paperboard/P.E. Yet another laminate construction, having medium barrier properties, consists of P.E./paperboard/P.E./P.E. The P.E. may vary in thickness from 0.5 to 1.5 mil, and it may comprise either low or high density P.E., or combinations thereof. Moreover, other plastics such as Surlyn, polypropylene, and the like may be substituted for, or used in conjunction with, P.E., depending upon the final barrier properties required. The paperboard layer may vary in thickness between 12 and 25 mils, and the aluminum foil is generally 0.00035 inches thick. It will be obvious that a laminate construction can be designed to meet varying barrier requirements. The bottom of the container is generally made from the same material as the side walls. In general, the plastic top closure construction 10 will be manufactured from a plastics material having a thickness varying between 15 and 30 mils, depending upon the strength and barrier requirements of the product packaged within the container. It will also be recognized that the containers may be manufactured in various shapes, i.e., round, oval, oblong, or "rectangular" with rounded corners. Since the body of the container is manufactured from a blank, no extra labeling is required since the blanks can be pre-printed.

Generally speaking, the present invention is directed to a top closure lid construction for a container. The lid is integrally formed from a plastics cover member, the member carrying a main paperboard insert on its upper surface, the member and insert being secured together. The plastics cover member has an integral tongue to define, upon tongue pivoting, an opening in the member. The main paperboard insert is hinged about a contiguous pivot axis and carries a pull tab. Spaced lugs or detents are provided to facilitate reclosing of the closure. If formed from a brittle plastics material, pulling the pull tab breaks the plastics member at its tongue hinge. The closure lid further includes an upstanding wall which enables stacking.

Although the invention has been described above by reference to a preferred embodiment, it will be appreciated that other constructions may be devised, which are, nevertheless, within the scope and spirit of the invention and are defined by the claims appended hereto.

What is claimed is:

1. A top closure lid construction for a container, the lid being formed of:

(a) a cover member formed of a relatively brittle plastics material, the cover member having means along its periphery for sealing attachment to the upper open end portion of a container, the cover member having a tongue formed integrally therefrom, the tongue partially defined by a weakened hinge-forming line to serve as a hinge for the tongue, the remainder of the tongue defined by a curved cut line extending through the thickness of the cover member, the ends of the cut line terminating, respectively, at the ends of the weakened hinge-forming line, whereby when the tongue is pivoted upwardly about its hinge-forming line, a dispensing opening is defined in the cover member; and (b) a main paperboard insert superposed on and bonded to the top surface of the cover member and having an end area overlying said tongue, the main paperboard insert having a fold line overlying and substantially aligned with the weakened hinge-forming line of the cover member, the said end area of the main paperboard insert having a pull tab connected thereto, whereby when the pull tab is pulled upwardly, both the cover member tongue and the overlying end area of the main paperboard insert pivot about their respective hinges and fold lines to thereby define an opening in the cover member and the cover member tongue is at least partially broken off from the remainder of the cover member and the tongue is thereafter carried by the end area of the main paperboard insert to thereby preclude blocking of the dispensing opening during dispensing by the inherent resiliency of the plastics cover member material from which the tongue is formed.

2. The top closure lid construction of claim 1 wherein the cover member tongue is of a smaller area than that of the end area of the main paperboard insert to which it is bonded.

3. The top closure lid construction of claim 1 wherein said main paperboard insert extends over the entire upper surface of said cover member.

4. The top closure lid construction of claim 1 wherein said cover member carries means for releasably and resiliently maintaining said main paperboard end area in its closed position relative to the cover member, whereby after the pull tab is initially pulled up to thereby define an opening in the cover member, the end area and the tongue may be reclosed and resiliently and releasably maintained in the closed position until reuse.

5. The top closure lid construction of claim 4 wherein the means for releasably resiliently maintaining the paperboard end area in its closed position is defined by spaced detents carried by a peripheral portion of the cover member, the detents extending over and slightly radially inwardly of the periphery of the main paperboard insert.

6. The top closure lid construction of claim 5 wherein the detents are integral with the cover member.

7. The top closure lid construction of claim 6 wherein the detents are upwardly tapered.

8. The top closure lid construction of claim 5 wherein at least one of said detents is positioned adjacent the fold line of the main paperboard insert and toward said pull tab, whereby when the said end area is pulled up by the pull tab it swings about its fold line and is squeezed in passing beyond said at least one detent, whereby the end area is precluded from swinging back to its closed position unless pushed back by the user.

9. The top closure lid construction of claims 1 or 8, wherein the cover member is provided with a depression to form a storage well, the top of the well being closed by the main paperboard insert.

10. The top closure lid construction of claims 1 or 8 wherein said cover member is provided with an upstanding peripherally disposed stacking flange, said flange adopted to stackingly fit into the bottom of a container stacked on top of it.

11. The top closure lid construction of claim 1 wherein the relatively brittle plastics material forming the cover member is styrene.

* * * * *